US010600588B2

(12) United States Patent
Freundt

(10) Patent No.: US 10,600,588 B2
(45) Date of Patent: Mar. 24, 2020

(54) SWITCH HAVING AN ARC-QUENCHING DEVICE

(71) Applicant: SIEMENS AKTIENGESELLSCHAFT, Munich (DE)

(72) Inventor: Karsten Freundt, Falkensee (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/315,070

(22) PCT Filed: Jun. 7, 2017

(86) PCT No.: PCT/EP2017/063752

§ 371 (c)(1),
(2) Date: Jan. 3, 2019

(87) PCT Pub. No.: WO2018/007083

PCT Pub. Date: Jan. 11, 2018

(65) Prior Publication Data

US 2019/0157020 A1 May 23, 2019

(30) Foreign Application Priority Data

Jul. 6, 2016 (DE) ..... 10 2016 212 335

(51) Int. Cl.

| | |
|---|---|
| ***H01H 9/42*** | (2006.01) |
| ***H01H 9/44*** | (2006.01) |
| ***H01H 33/18*** | (2006.01) |
| ***H01H 33/16*** | (2006.01) |
| ***H01H 9/34*** | (2006.01) |

(52) U.S. Cl.

CPC ..... *H01H 9/42* (2013.01); *H01H 9/34* (2013.01); *H01H 9/446* (2013.01); *H01H 33/164* (2013.01); *H01H 33/185* (2013.01); *H01H 33/167* (2013.01)

(58) Field of Classification Search

CPC ..... H01H 9/42; H01H 33/164; H01H 33/185; H01H 9/34; H01H 9/446; H01H 33/167

See application file for complete search history.

(56) References Cited

U.S. PATENT DOCUMENTS

| | | | | |
|---|---|---|---|---|
| 2,196,820 A | | 4/1940 | Verse | |
| 3,004,116 A | | 10/1961 | Griscom | |
| 4,328,458 A | * | 5/1982 | Hiromitsu | H01F 29/14 307/17 |

(Continued)

FOREIGN PATENT DOCUMENTS

| | | |
|---|---|---|
| CN | 1879183 A | 12/2006 |
| CN | 103348429 A | 10/2013 |

(Continued)

*Primary Examiner* — Truc T Nguyen

(74) *Attorney, Agent, or Firm* — Laurence Greenberg; Werner Stemer; Ralph Locher

(57) ABSTRACT

A switching device in a vacuum switching tube or for arc quenching in gases. The switching device has an arc-quenching device. There is also described a method for operating a switching device in a vacuum switching tube or in arc quenching in gases, which switching device has an arc-quenching device for medium-voltage, low-voltage and/or high-voltage applications.

13 Claims, 2 Drawing Sheets

(56) References Cited

U.S. PATENT DOCUMENTS 5,548,258 A * 8/1996 Kuboyama ..... H01H 9/446 335/16
5,579,198 A * 11/1996 Wieloch ..... H01H 77/06 335/124
5,589,672 A * 12/1996 Uchida ..... H01H 9/342 218/34
6,310,528 B1 * 10/2001 Kuboyama ..... H01H 71/2409 335/132
6,417,749 B1 * 7/2002 Kappel ..... H01H 50/026 335/132
6,700,466 B1 * 3/2004 Yamamoto ..... H01H 9/302 218/156
9,502,195 B2 11/2016 Freundt
9,543,086 B2 1/2017 Ermel et al.
9,552,934 B2 1/2017 Cardwell et al.
2003/0231453 A1 * 12/2003 Shea ..... H01H 79/00 361/220
2008/0079519 A1 * 4/2008 Shea ..... H01H 77/108 335/201
2012/0261382 A1 10/2012 Fasano
2013/0264311 A1 10/2013 Lang et al.
2013/0313228 A1 11/2013 Friedrichsen et al.
2014/0353280 A1 12/2014 Ozkaya et al.
2015/0028973 A1 1/2015 Cardwell et al.
2015/0206666 A1 * 7/2015 Naka ..... H01H 50/546 218/146
2015/0318129 A1 * 11/2015 Freundt ..... H01H 9/44 218/22
2016/0133413 A1 * 5/2016 Bock ..... H01H 33/08 361/142
2018/0012720 A1 * 1/2018 Sasaki ..... H01H 71/0235

FOREIGN PATENT DOCUMENTS

CN 103403827 A 11/2013
CN 204390941 U 6/2015
CN 105280431 A 1/2016
DE 678745 C 7/1939
DE 19910119 A1 9/2000
DE 102012025115 A1 6/2014
DE 102012222328 A1 6/2014
EP 1683173 B1 9/2007
EP 2820665 A1 1/2015
FR 810009 A 3/1937
WO 2014086587 A1 6/2014

* cited by examiner

SWITCH HAVING AN ARC-QUENCHING DEVICE

BACKGROUND OF THE INVENTION

Field of the Invention

The invention relates to a switching device having a vacuum switching tube, or for arc quenching in gases by means of an arc-quenching device, and to a method for operating a switching device having an arc-quenching device.

Switching devices having a contact system comprised of a moveable contact and a fixed contact, and an arc-quenching device, are known from the general prior art. For example, in the low-voltage range, switches having a fixed contact and a rotatably-mounted moveable contact are known, wherein an arc-quenching device is provided inter alia in the form of arc splitters.

US 20120261382 A1 thus describes a system of this type having a moveable contact, a fixed contact and an arc-quenching device, wherein the arc-quenching device is comprised of arc splitters and a magnetic field generating device, which suppresses the resulting arc in the arc splitters.

A switching system is known from WO 2014086587, wherein the occurrence of arcing upon the opening of the contact system is employed for the generation of a counter-current, which is configured to counteract the externally-applied voltage.

SUMMARY OF THE INVENTION

The object of the present invention is the provision of a switching device having an improved arc-quenching property.

This object is fulfilled by the independent, and by the claims which are dependent upon said claims.

In one exemplary embodiment, a switching device for application in a vacuum switching tube or in gas-insulated switchgear comprises a contact system having at least one moveable contact and at least one fixed contact, wherein the moveable contact is connected to a first electrical contact in an electrically conductive manner, and the fixed contact is connected to a second electrical contact in an electrically conductive manner. The switching device moreover comprises an arc-quenching device, having an arrangement for the generation of a magnetic field which is constituted in a perpendicular plane to the direction of motion of the moveable contact, wherein the arrangement for the generation of the magnetic field comprises a U-shaped core, the base of which is arranged between the fixed contact and an electrical connecting lead of the fixed contact which constitutes a first current loop, wherein the connecting lead connects the fixed contact to the second electrical contact in an electrically conductive manner, and the two limbs of which, i.e. the limbs of the U-shaped core, extend along the contact system, around said contact system.

The arc-quenching device further comprises two or more arc-quenching electrodes, wherein:

- the two or more arc-quenching electrodes are configured in a laterally offset arrangement from the contact system, such that the moveable contact of the contact system, in its movement, is not restricted by the two or more arc-quenching electrodes,
- the two or more arc-quenching electrodes, with the contact system in the open state, are laterally offset between the moveable contact and the fixed contact,

- the two or more arc-quenching electrodes are arranged perpendicularly to the direction of motion of the moveable contact, and
- the two or more arc-quenching electrodes are arranged on an open side of the U-shaped core of the arrangement for the generation of the magnetic field, such that a Lorentz force can act on moving electrons in a plasma of an arc in the magnetic field of the arrangement for the generation of the magnetic field.

The arc-quenching device further comprises an electrical counter-pulse device for the generation of an electrical counter-pulse between the arc-quenching electrodes. This is achieved by means of capacitors, coils or other circuit elements which generate an electrical counter-pulse for the quenching of the arc between the arc-quenching electrodes. The electrical counter-pulse device comprises at least one first capacitor, at least one coil and/or at least one other circuit element for the generation of an electrical counter-pulse, wherein the electrical counter-pulse device:

- is connected to the first electrical contact and the second electrical contact in an electrically conductive manner, and
- the electrical counter-pulse device is connected to the two or more arc-quenching electrodes in an electrically conductive manner, such that a first arc-quenching electrode of the two or more arc-quenching electrodes, in the open state of the contact system, is arranged in closer spatial proximity to the fixed contact than to the moveable contact, and that the electrical counter-pulse device, on a first side, is connected to the first arc-quenching electrode in an electrically conductive manner, wherein the first side assumes the polarity of the first electrical contact, and
- the electrical counter-pulse device is connected to the two or more arc-quenching electrodes in an electrically conductive manner, such that a second arc-quenching electrode of the two or more arc-quenching electrodes, in the open state of the contact system, is arranged in closer spatial proximity to the moveable contact than to the fixed contact, and that the electrical counter-pulse device, on a second side, is connected to the second arc-quenching electrode in an electrically conductive manner, wherein the second side assumes the polarity of the second electrical contact.

If more than two arc-quenching electrodes are employed, these are to be arranged and electrically connected to the electrical counter-pulse device such that at least two of the arc-quenching electrodes are connected to the electrical counter-pulse device in an electrically conductive manner, such that two adjacent arc-quenching electrodes, or two arc-quenching electrodes separated by one or more arc-quenching electrodes, respectively constitute an arcing path, wherein a first arc-quenching electrode, in the open state of the contact system, is arranged in closer spatial proximity to the fixed contact than a second arc-quenching electrode, and the electrical counter-pulse device, on a first side, is connected to the first arc-quenching electrode in an electrically conductive manner, wherein the first side assumes the polarity of the first electrical contact, and a second arc-quenching electrode, in the open state of the contact system, is arranged in closer spatial proximity to the moveable contact than the first arc-quenching electrode, and the electrical counter-pulse device, on a second side, is connected to the second arc-quenching electrode in an electrically conductive manner, wherein the second side assumes the polarity of the second electrical contact.

By means of the design described above, an arc generated upon the opening of the contact system is moved by means of an arc-quenching device, having an arrangement for the generation of a magnetic field which is constituted in a perpendicular plane to the direction of motion of the moveable contact, towards the two or more arc-quenching electrodes, and the arc sparks over onto the arc-quenching electrodes. As a result, additionally, the electrical counter-pulse device is discharged such that, via the arc-quenching electrodes, a counter-pulse which counteracts the arcing current is introduced into the arc-quenching device, such that the arc is quenched.

An arc-quenching device having two arc-quenching electrodes is preferred.

The arc-quenching electrodes are preferably configured in the form of arc splitter plates.

It is also preferred that the arc-quenching electrodes are partially insulated, such that only the region in which the arc is intended to spark over from the contacts of the contact system to the arc-quenching electrodes, and/or the arc is intended to spark over between the arc-quenching electrodes, is not insulated.

It is particularly preferred that the insulation constitutes a U-shaped insulating jacket around the respective arc-quenching electrode.

It is particularly preferred that the limbs of the U-shaped insulating jacket are not configured to an equal length, or at least not all to an equal length. Additional control of the constitution of the arc can be achieved accordingly. Specifically, the spark-over of the arc to any shielding elements can additionally be prevented as a result.

It is further preferred that the arc splitter plates are arranged parallel to the base of the U-shaped core.

It is also preferred that the arc splitter plates, on the side thereof which faces the contact system, have a surface area which is enlarged in relation to a plate wherein, specifically, an enlarged surface area is achieved by a thickening or curvature of the arc splitter plates. The curved arc splitter plates preferably incorporate a radius, i.e. a region which is at least partially curved to form a radius of a circle.

It is also preferred that no extinction current switching element is required for the discharging of the electrical counter-pulse device, as the switching process is initiated by the arc in the arc splitter plates. Alternatively, however, discharging of the electrical counter-pulse device can be tripped by an extinction current switching element, as an additional switching element. It is thus achieved that the potential for the generation of the counter-pulse is only applied to the arc-quenching electrodes once the arc has already sparked over to the arc-quenching electrodes, and has thus been switched to the path constituted by the arc-quenching electrodes.

It is also preferred that a time delay can be set and/or provided between the opening of the contact system and the closing of the extinction current switching element, wherein the time delay can be zero, or less than zero, or greater than zero. Time delays of the order of a few milliseconds up to a few tens of milliseconds are preferred.

It is also preferred that the U-shaped core is a U-shaped iron core.

It is preferred that the switching device is arranged in a vacuum switching tube.

Alternatively, the switching device can also be arranged in a gas-insulated region or in an air-insulated region.

It is further preferred that the electrical counter-pulse device is configured with capacitors, and comprises a first capacitor, a second capacitor and a third capacitor, wherein the first capacitor, the second capacitor and the third capacitor are connected in series.

Alternatively, a transformer, with or without an additional first capacitor, can be employed. The electrical counter-pulse device then comprises at least one parallel circuit comprised of the first capacitor and the transformer, wherein the first capacitor is connected to two or more of the arc-quenching electrodes in an electrically conductive manner. In the absence of the additional first capacitor, the electrical counter-pulse device is comprised only of the at least one transformer, wherein the at least one transformer is connected to two or more of the arc-quenching electrodes in an electrically conductive manner. The form of execution having a transformer provides galvanic isolation between the main current circuit and the electrical counter-pulse device.

It is also preferred that the moveable contact is bonded in an electrically conductive manner by means of a second current loop, which is angled through 90°, and the moveable contact, with at least part of the 90°-angled second current loop, is arranged in the U-shaped core of the arrangement such that, upon the opening of the energized contact system, a second force acts on the moveable contact, which is oriented in the direction of the opening moveable contact. Specifically, the second current loop is angled through 90° in relation to the direction of motion of the moveable contact.

It is also preferred that the opening of the contact system is executed exclusively by the second force.

Alternatively, the opening of the contact system can be executed by an external force, which is transmitted from the exterior of the arc-quenching device to the moveable contact, and by the second force. This means that, in the opening of the contact system, for example, additionally to the second force, a further force acts on the moveable contact, such that the moveable contact is moved away from the fixed contact. This further force can be generated, for example, by spring elements, by mechanical spring elements, or by a mechanical or electromagnetic drive.

It is further preferred that the switching device is designed for medium-voltage, low-voltage and/or high-voltage applications, i.e. is designed for the switching of low voltages, medium voltages and/or high voltages.

It is specifically preferred that the switching device is designed for medium-voltage and/or high voltage applications, i.e. is designed for the switching of medium voltages and/or high voltages.

It is also preferred that the switching device is a switching device which is configured for the switching of direct current.

Alternatively, the switching device can be a switching device which is configured for the switching of alternating current.

It is further preferred that the switching device is employed for current limiting.

It is also preferred that the moveable contact of the contact system is connected to the first electrical contact by means of a sliding contact or a flexible conductor, or a combination of the two.

In one exemplary embodiment, a method is provided for the operation of a switching device of the above-mentioned design, wherein an arc generated upon the opening of the contact system is moved by means of an arc-quenching device, having an arrangement for the generation of a magnetic field which is constituted in a perpendicular plane to the direction of motion of the moveable contact, towards the two or more arc-quenching electrodes, and the electrical counter-pulse device is thus discharged such that, via the arc-quenching electrodes, a counter-pulse which counteracts the arcing current is introduced into the contact system, such that the arc is quenched in the arc-quenching device.

BRIEF DESCRIPTION OF THE SEVERAL VIEWS OF THE DRAWING

The invention is described hereinafter on the basis of two figures and one exemplary embodiment, with reference to the attached figures.

DESCRIPTION OF THE INVENTION

Figure 1:
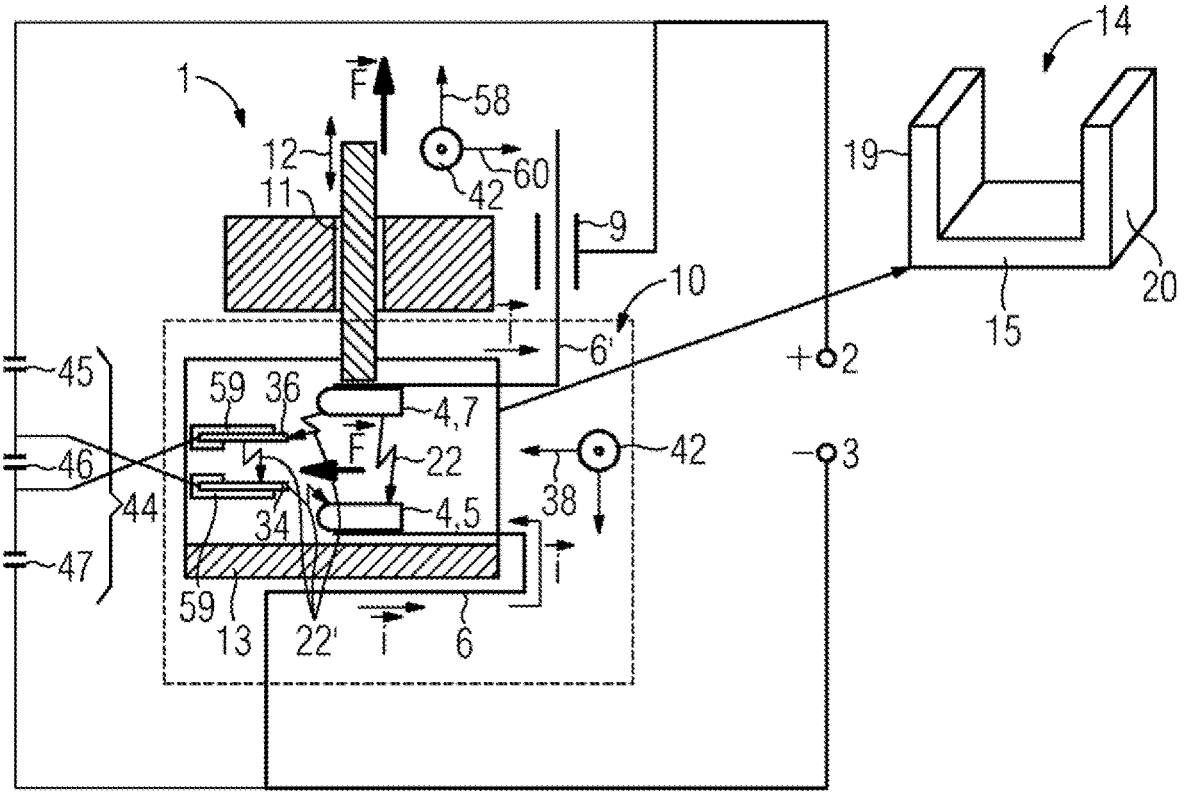
FIG. 1: shows a schematic view of an exemplary embodiment of a switching device with an open contact system.

FIG. 1 shows a schematic view of the switching device 1 with an open contact system 4. The contact system 4 is comprised of a fixed contact 5 and a moveable contact 7. The contact system 4 and an arrangement 13 for the generation of a magnetic field 42 of an arc-quenching device are arranged in a vacuum tube 10, only an indication of which is included in FIG. 1.

The moveable contact 7 is connected via a second conductor loop 6 and a sliding contact 9 to a first electrical contact 2. In this case, the moveable contact 7 is guided, for example, in a bearing 11. A vacuum-tight connection of the moveable contact 7 to a vacuum tube can be achieved by means of a bellows, folding bellows or corrugated bellows—which are not represented here. This arrangement can also be operated in gases, which is not represented. The fixed contact 5 is connected via the first current loop 6 to a second electrical contact 3.

The contact system 4 is arranged in an arc-quenching device, which incorporates an arrangement 13 for generating a magnetic field 42. The arrangement 13 comprises a U-shaped core 14 having a base 15, a first limb 19 and a second limb 20. The limbs 19, 20 enclose two sides of the U-shaped core, whereas two further sides are open. The region of the U-shaped core 14 arranged opposite the base 15 is likewise open.

The first arc-quenching electrode 34 and the second arc-quenching electrode 36 are arranged with a lateral offset from the contact system 4, such that the moveable contact 7 of the contact system 4, in its movement, is not restricted by the two arc-quenching electrodes 34, 36. In the open state of the contact system 4, the two arc-quenching electrodes 34, 36 are laterally offset between the moveable contact 7 and the fixed contact 5. The two arc-quenching electrodes 34, 36 are situated on one of the open sides of the U-shaped core 14, specifically on the open side of the U-shaped core 14 upon which a Lorentz force 38 acts on the moving electrons in the plasma of the arc 22 in the magnetic field 42 of the arrangement 13.

In FIG. 1, the arc-quenching electrodes incorporate U-shaped insulating jackets 59.

FIG. 1 represents a situation in which the first electrical contact 2 lies at a negative potential, and the second electrical contact 3 lies at a positive potential. In the event of an inverse polarity, the device operates in an analogous manner, such that both alternating currents and direct currents can be switched. As a result of the current which flows in response to the potential difference, an arc 22 is generated upon the opening of the contact system 4, in the plasma of which electrons move from the moveable contact 7 to the fixed contact 5. As a result of the magnetic field 42 generated by the arrangement 13, the electrons in the plasma of the arc 22 move in the direction of the arc-quenching electrodes 34, 36. As a result, the arc sparks over to the arc-quenching electrodes 36, 34. The arc-quenching device further comprises an electrical counter-pulse device 44 having at least one first capacitor 46. In the exemplary embodiment represented in FIG. 1, the electrical counter-pulse device 44 incorporates a capacitor 46, a second capacitor 45, and a third capacitor 47.

The electrical counter-pulse device 44 is connected to the first electrical contact 2 and to the second electrical contact 3.

The first arc-quenching electrode 34 which, in the open state of the contact system 4, is arranged in closer spatial proximity to the fixed contact 5 than to the moveable contact 7, is electrically connected to the side of the first capacitor 46 which carries the polarity of the first electrical contact 2.

The second arc-quenching electrode 36 which, in the open state of the contact system 4, is arranged in closer spatial proximity to the moveable contact 7 than to the fixed contact 5, is connected to the side of the first capacitor 46 which carries the polarity of the second electrical contact 3.

By means of this arrangement, and the electrical connection of the arc-quenching electrodes 34, 36, in the event of the spark-over of an arc from one contact (in this case, the moveable contact 7) via the arc-quenching electrodes 36, 34 to the other contact (in this case, the fixed contact 5), a counter-current is injected from the capacitor 46 into the arc-quenching device. This results in the quenching of the arc 22.

Additionally, by means of the second conductor loop 6' which is angled through 90°, the current flowing in said conductor loop 6' and the magnetic field 42 generated by the arrangement 13 exert a force on the moveable contact, which results in the opening of the contact system 4, or in the accelerated opening of the contact system 4.

Figure 2:
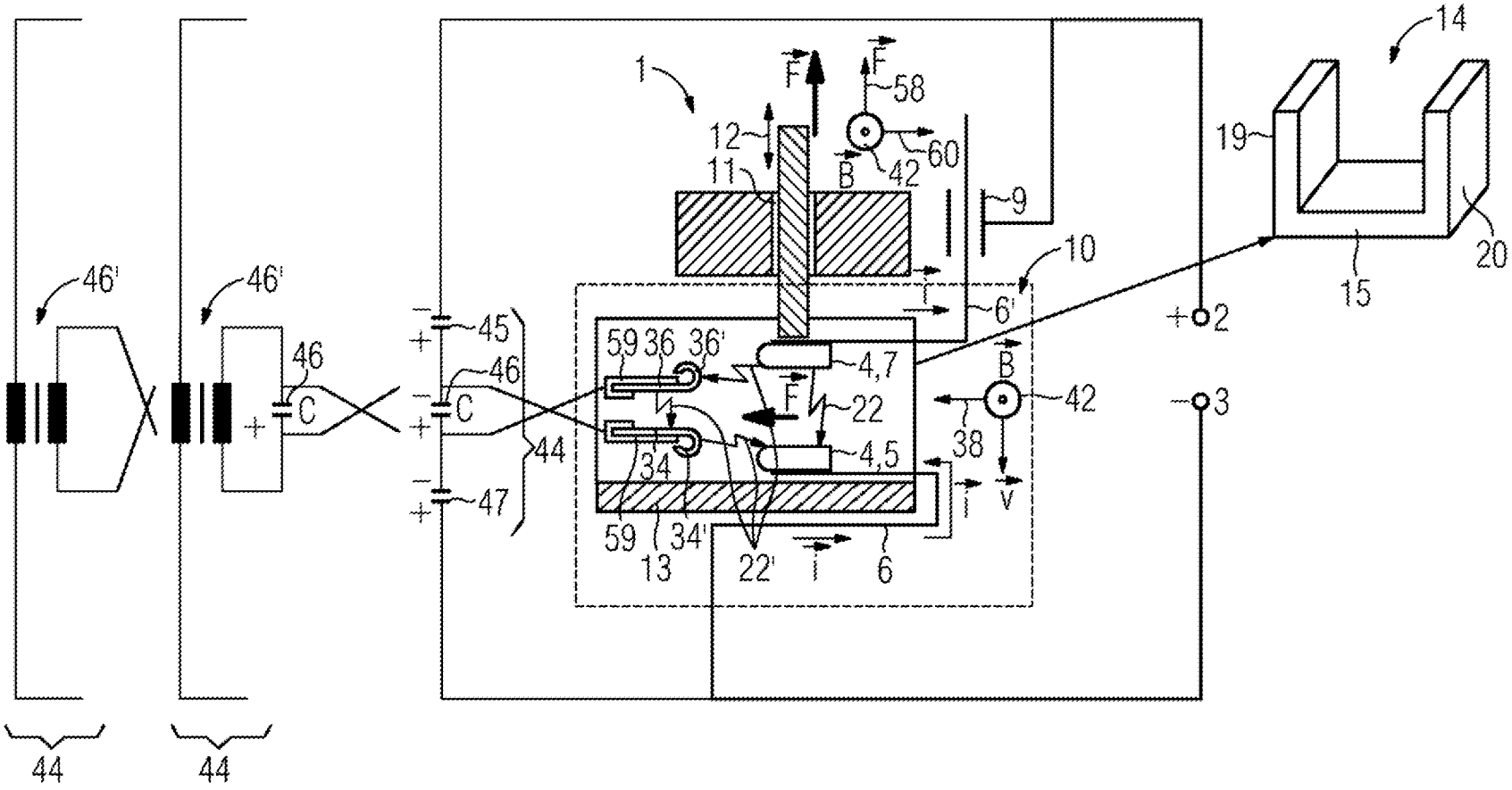
FIG. 2: shows a schematic view of an exemplary embodiment of a switching device with an open contact system, having alternative electrical counter-pulse devices.

FIG. 2 represents the exemplary embodiment of the switching device 1 according to FIG. 1, and additionally shows two alternative embodiments of the electrical counter-pulse device 44, having a transformer 46 or a transformer 46' and a first capacitor 46.

FIG. 2, analogously to FIG. 1, shows the design of the contact system 4, having the moveable contact 7 and the fixed contact 5. The fixed contact 5 is electrically connected via a first current loop 6 to a second electrical contact 3. The moveable contact 7 is electrically connected via a second contact loop 6' and the sliding contact 9 to the first contact 2.

The moveable contact is moveably mounted in the bearing 11, and can move in the direction of motion 12.

The arrangement 13 having the U-shaped core 14, the base 15, the first limb 19 and the second limb 20 is employed for the generation of a magnetic field 42 which, in the event of the occurrence of an arc 22 in the contact system 4, in combination with the movement of electrons in the plasma of the arc 22, exerts a Lorentz force 38.

By the action of the Lorentz force 38, the arc is moved onto the arcing path 22' via the arc-quenching electrodes 34, 36. In the event of the spark-over of the arc 22 to the arc-quenching electrodes 34, 36, a counter-pulse is applied to the arc-quenching electrodes 34, 36 by the electrical counter-pulse device 44, such that the arc 22 on the arcing path 22' is quenched.

The force 58 resulting from the magnetic field 42 and the current 60 in the conductor loop 6' and acting on the moveable contact 7 is represented in an analogous manner to FIG. 1.

The arc-quenching electrodes 34, 36 in FIG. 2 again incorporate optional U-shaped insulating jackets 59.

The arc-quenching electrodes 34, 36 additionally incorporate optional surface area enlargements, and thus respectively constitute a first arc-quenching electrode having a surface area enlargement 34', and a second arc-quenching electrode having a surface area enlargement 36'.

In addition to the electrical counter-pulse device 44 in FIG. 1, having the first capacitor 46, the second capacitor 45 and the third capacitor 47, FIG. 2 also shows two alternative electrical counter-pulse devices 44. However, only one variant of the electrical counter-pulse device 44 is employed.

The first alternative electrical counter-pulse device 44 comprises a transformer 46' and a first capacitor 46 which is parallel-connected to the transformer 46'. In an analogous manner to FIG. 1, the capacitor 46 is connected to the arc-quenching electrodes 34, 36 such that, in the event of an arc 22, said arc 22 is quenched on the arcing path 22' by a counter-pulse from the electrical counter-pulse device 44.

The second alternative electrical counter-pulse device 44 comprises a transformer 46'. In an analogous manner to the capacitor 46 in FIG. 1, the transformer 46' is connected to the arc-quenching electrodes 34, 36 such that, in the event of an arc 22, said arc 22 is quenched on the arcing path 22' by a counter-pulse from the electrical counter-pulse device 44.

The option for the provision of one or more further capacitors up-circuit and down-circuit of a transformer 46' is not represented or described in further detail.

LIST OF REFERENCE NUMBERS

1 Switching device
2 First electrical contact
3 Second electrical contact
4 Contact system
5 Fixed contact of the contact system
6 First current loop for the generation of the magnetic field with the arrangement 13
6' Second current loop for the generation of a force 58 on the moveable contact 7
7 Moveable contact of the contact system
9 Sliding contact
10 Vacuum tube
11 Bearing
12 Direction of motion
13 Arrangement
14 U-shaped core
15 Base
19 First limb
20 Second limb
22 Arc
34 First arc-quenching electrode
34' First arc-quenching electrode with surface area enlargement
36 Second arc-quenching electrode
36' Second arc-quenching electrode with surface area enlargement
38 Lorentz force resulting from the magnetic field 42 and the movement of the electrons
42 Magnetic field and orientation of magnetic field constituted by the arrangement 13
44 Electrical counter-pulse device
45 Second capacitor
46 First capacitor
46' Transformer
47 Third capacitor
58 Force resulting from the magnetic field 42 and the current 60 in the conductor loop 6', acting on the moveable contact
59 U-shaped insulating jacket
60 Current or current flux I

The invention claimed is:

1. A switching device for application in a vacuum switching tube or for arc quenching in gases, the switching device comprising:

a contact system having a moveable contact electrically conductively connected to a first electrical contact and a fixed contact electrically conductively connected to a second electrical contact;

an arc-quenching device having:

an arrangement for generating a magnetic field which is constituted in a perpendicular plane to a direction of motion of said moveable contact, wherein said arrangement for generating the magnetic field including a U-shaped core having a base arranged between said fixed contact and an electrical connecting lead of said fixed contact which constitutes a first current loop, wherein said connecting lead connects said fixed contact to said second electrical contact in an electrically conductive manner, and said U-shaped core having two limbs that extend along said contact system, around said contact system;

two or more arc-quenching electrodes laterally offset from said contact system such that a movement of said moveable contact of said contact system is not restricted by said two or more arc-quenching electrodes;

said two or more arc-quenching electrodes, when said contact system is in an open state, being laterally offset between said moveable contact and said fixed contact;

said two or more arc-quenching electrodes being arranged perpendicularly to the direction of motion of said moveable contact; and said two or more arc-quenching electrodes being arranged on an open side of said U-shaped core of said arrangement for generating the magnetic field, such that a Lorentz force can act on moving electrons in a plasma of an arc in the magnetic field of said arrangement for generating the magnetic field;

an electrical counter-pulse device having at least one first capacitor and/or having at least one transformer, wherein said electrical counter-pulse device:

is connected to said first electrical contact and to said second electrical contact; and is connected to said two or more arc-quenching electrodes such that a first arc-quenching electrode of said two or more arc-quenching electrodes, in the open state of said contact system, is arranged in closer spatial proximity to said fixed contact than to said moveable contact, and such that said first capacitor and/or said at least one transformer, on a first side, is connected to said first arc-quenching electrode, wherein the first side assumes a polarity of said first electrical contact; and is connected to said two or more arc-quenching electrodes, such that a second arc-quenching electrode of said two or more arc-quenching electrodes, in the open state of said contact system, is arranged in closer spatial proximity to said moveable contact than to said fixed contact, and such that said first capacitor and/or said at least one transformer (46'), on a second side, is connected to said second arc-quenching electrode, wherein the second side assumes a polarity of said second electrical contact.

2. The switching device according to claim 1, wherein said electrical counter-pulse device comprises a first capacitor or said electrical counter-pulse device comprises a first capacitor, a second capacitor and a third capacitor, and wherein said first capacitor, said second capacitor and said third capacitor are connected in series.

3. The switching device according to claim 2, wherein:

said electrical counter-pulse device comprises at least one parallel circuit comprised of said first capacitor and said transformer, wherein said first capacitor is connected to two or more of said arc-quenching electrodes in an electrically conductive manner; or said electrical counter-pulse device is comprised only of said at least one transformer, wherein said at least one transformer is connected to two or more of said arc-quenching electrodes in an electrically conductive manner.

4. The switching device according to claim 1, wherein:

said moveable contact is bonded by way of a second current loop, which is angled through 90°; and said moveable contact, with at least part of said 90°-angled second current loop, is arranged in said U-shaped core of said arrangement such that, upon opening the energized contact system, a second force acts on said moveable contact that is oriented in the direction of the opening moveable contact.

5. The switching device according to claim 4, wherein an opening of said contact system is executed exclusively by the second force.

6. The switching device according to claim 4, wherein an opening of said contact system is executed by an external force, which is transmitted from an exterior of said arc-quenching device to said moveable contact, and by the second force.

7. The switching device according to claim 1, configured for medium-voltage, low-voltage and/or high-voltage applications.

8. The switching device according to claim 1, configured as a switching device for direct current.

9. The switching device according to claim 1, configured as a switching device for alternating current.

10. The switching device according to claim 1, configured as a switching device for current limiting.

11. The switching device according to claim 1, further comprising a sliding contact and/or a flexible conductor connecting said moveable contact of said contact system to said first electrical contact.

12. A method of operating a switching device according to claim 1, the method comprising:

providing an arc-quenching device with an arrangement for generating a magnetic field which is constituted in a perpendicular plane to the direction of motion of a moveable contact in a contact system;

moving an arc that is generated upon the opening of the contact system by means of the arc-quenching device towards two or more arc-quenching electrodes of the arc-quenching device; and thus discharging the electrical counter-pulse device such that, via the arc-quenching electrodes, a counter-pulse which counteracts the arcing current is introduced into the contact system, to thereby quench the arc in the arc quenching device.

13. The method according to claim 12, wherein the counter-pulse of the electrical counter-pulse device is an electric voltage or an electric current.

* * * * *